United States Patent [19]

Metzinger

[11] 3,934,286

[45] Jan. 27, 1976

[54] HAND TOOL

[76] Inventor: Robert E. Metzinger, Rural Rte. 1, Oxford, Ind. 47971

[22] Filed: Jan. 16, 1975

[21] Appl. No.: 541,426

[52] U.S. Cl. ..... 7/3 A; 254/28; 29/268; 81/5.1

[51] Int. Cl.[2] ..... B25B 7/22; B25C 11/02

[58] Field of Search ..... 254/28, 22; 7/3 A, 5.4; 29/248, 267, 268, 283; 81/5.1

[56] References Cited

UNITED STATES PATENTS

| | | | |
|---|---|---|---|
| 50,303 | 10/1865 | Lawrence | 7/3 A |
| 218,082 | 7/1879 | Taylor | 254/28 |
| 650,186 | 5/1900 | Maxson | 254/28 |
| 715,915 | 12/1902 | White | 7/3 A |
| 832,387 | 10/1906 | Jensen | 254/22 |
| 2,431,922 | 12/1947 | Curtiss | 254/28 |
| 3,241,814 | 3/1966 | Forte | 254/28 |
| D51,912 | 3/1918 | Widell | 7/3 A |

*Primary Examiner*—Al Lawrence Smith
*Assistant Examiner*—Roscoe V. Parker
*Attorney, Agent, or Firm*—Woodard, Weikart, Emhardt & Naughton

[57] ABSTRACT

A hand tool which can be conveniently used with the staples used to fasten an electrical wire to a supporting structure. The hand tool comprises two lever arms which are pivotally joined at a point intermediate to their respective distal and proximal ends. The proximal end portions of the lever members are formed into handles while the distal portions are shaped into a pair of coacting jaw members. The jaw members are contoured so as to enable them to fit the contour of the staples so as to provide convenience in removal of the staples. The jaw members are also machined to enable cutting of the electrical wire during installation. Removal of staples is further facilitated by mounting a fulcrum member on one of the jaws. A hammerhead is mounted on the opposite jaw and is sized to allow the simultaneous striking of both nails generally required for hammering a staple into place.

6 Claims, 3 Drawing Figures

HAND TOOL

BACKGROUND OF THE INVENTION

1. Field of the Invention:

This invention relates to a hand tool which is functionally designed and uniquely constructed for successfully inserting and removing staples from electrical wire and cutting electrical wire which is to be fastened or is fastened onto a support structure.

2. Description of the Prior Art:

Many light duty type cutting, extracting tools have been devised and offered and are being used, but none of these available tools fills the needs of those who are called upon to use them. For example, one currently employed staple pulling hand tool comprises a small pry bar about five inches long with a one-half inch wide staple engaging and lifting end. This tool works with reasonable success only when the bridge or the bight portion of the anchored staple is accessible above the work surface. It is virtually useless when the staple is driven flush, and has been embedded and difficult to cope with. Another type of extractor comprises a small prying foot having a curved lever type handle wherein a wedge-like prying nib has to be forced and wedged into position under the bight portion of the staple before the levered step can be accomplished. This extractor has been found to be cumbersome. It serves only clumsily in many places which are difficult of access and cannot be relied upon for lifting crooked and embedded staples. For purposes of this application, terms such as extractor, pulley remover and others are used in the sense of not only being useful to remove staples but also useful in inserting staples.

In addition to the staple removers mentioned above, there are, of course, many heavy-duty staple pullers for use with fence wires and similar type objects. For the most part, the jaws are horn-like, beak shaped and sharp pointed and would, even if they were suitable for an electrician's use, snap and break the staple acted on with the result that valuable time and patience would be exhausted in removing embedded staple fragments with pliers. Unlike prior art staple extractors, the extractor herein disclosed employs specially shaped and contoured coacting jaws which are sized to engage most commonly used electrical wire staples, while at the same time being shaped such that they can cut the electrical wire. The staple which is being handled and/or removed by the hand tool and described herein seldom breaks and therefore can be yanked out fully and virtually intact.

An additional and more serious problem appreciated by many electricians is that when removing staples using a prying bar with standard pliers, the application of a force to the particular tool generally requires some sort of disfigurement or damage to the wire itself. This is unacceptable in that it at best leaves a weak point in the conductivity and insulation of the wire and is a place of high likelihood for the development of a short circuit. Additionally, there have been problems in the application and placement of the staples used to mount electrical wire. Mainly, it has been difficult to use these staples because with ordinary hammers only one nail at a time may be hit. Using the standard staples now commonplace to electricians, two nails are required at opposite ends of the staple. When only one nail may be hit per stroke, this leads to some deformation of the staple and nail. Using an alternative embodiment of the hand tool described herein, a hammerhead member is used to drive both nails used in mounting the staple simultaneously.

Known relevant prior art includes Maxson, U.S. Pat. No. 650,186 (1900), Lund, U.S. Pat. No. 919,370 (1909), Smith, U.S. Pat. No. 1,290,846 (1919), Bahre, U.S. Pat. No. 1,316,409 (1919), Young, U.S. Pat. No. 1,765,783 (1930), Monahon, U.S. Pat. No. 1,879,402 (1932), Curtiss, U.S. Pat. No. 2,431,922 (1947), Hanson, U.S. Pat. No. 2,474,940 (1949), Peterson, U.S. Pat. No. 2,629,114 (1953), Forte, U.S. Pat. No. 3,241,814 (1966), and Simon, U.S. Pat. No. 3,778,919 (1973).

SUMMARY OF THE INVENTION

This invention relates to a hand tool for use with electrical wire staples comprising a pair of levers pivotally connected at a point intermediate to the proximal and distal ends of the levers. The portions of the levers located proximal to the pivotal connection are adapted for use as handles while the portion of the levers located distal to the pivotal connection are adapted to serve as first and second coacting jaw members having opposing surfaces and distal edges. A fulcrum member is attached to one of the staple engaging jaw members and is laterally offset from the center of the first jaw member and extends beyond a plane through the distal edges of the jaw members.

It is an object of this invention to provide a hand tool which is useful in removing staples from electrical wire without deforming the electrical wire.

It is a further object of this invention to provide a hand tool which is useful for both removing and inserting staples which fasten an electrical wire to a supporting structure.

It is a still further object of this invention to provide a hand tool which has a fulcrum member laterally offset from the center of its longitudinal axis and which provides the leverage necessary to conveniently remove embedded staples from the member supporting an electrical wire.

It is an additional object of this invention to provide a hand tool which while having utility in inserting and removing staples also can be used to cut or sever the electrical wire.

These and other objects of this invention will become apparent from the following description of the preferred embodiment.

DESCRIPTION OF THE PREFERRED EMBODIMENT

Figure 1:
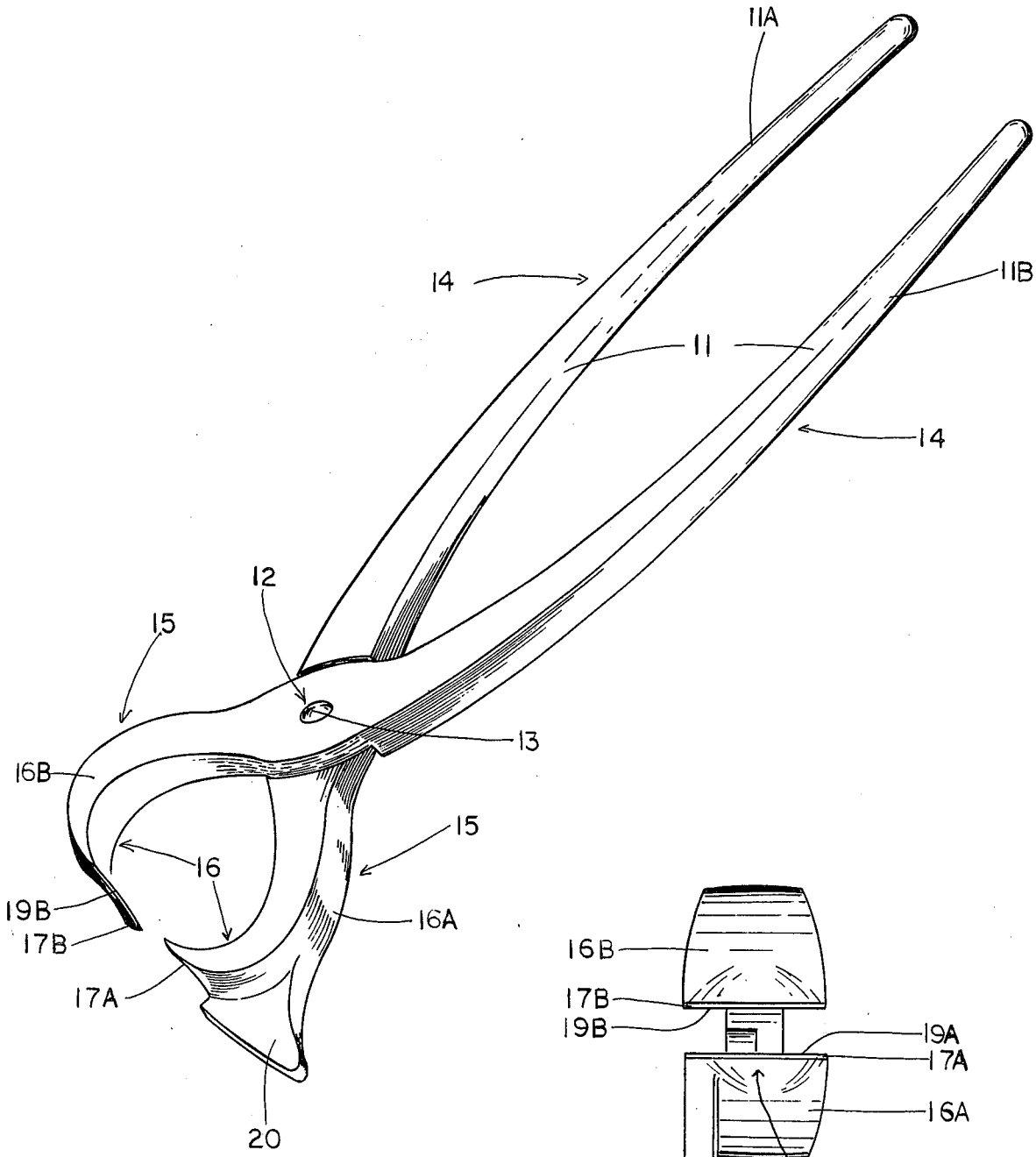
FIG. 1 is a perspective view of the hand tool of this invention.
Figure 2:
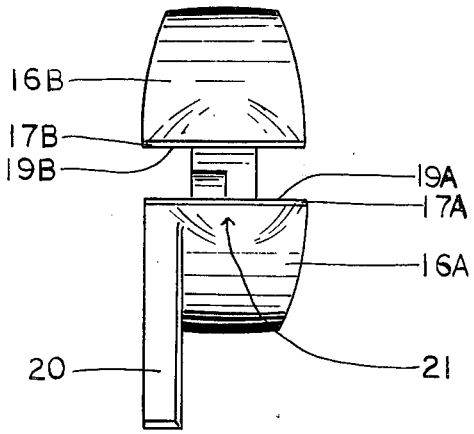
FIG. 2 is a front view of the coacting jaw members of this invention.
Figure 3:
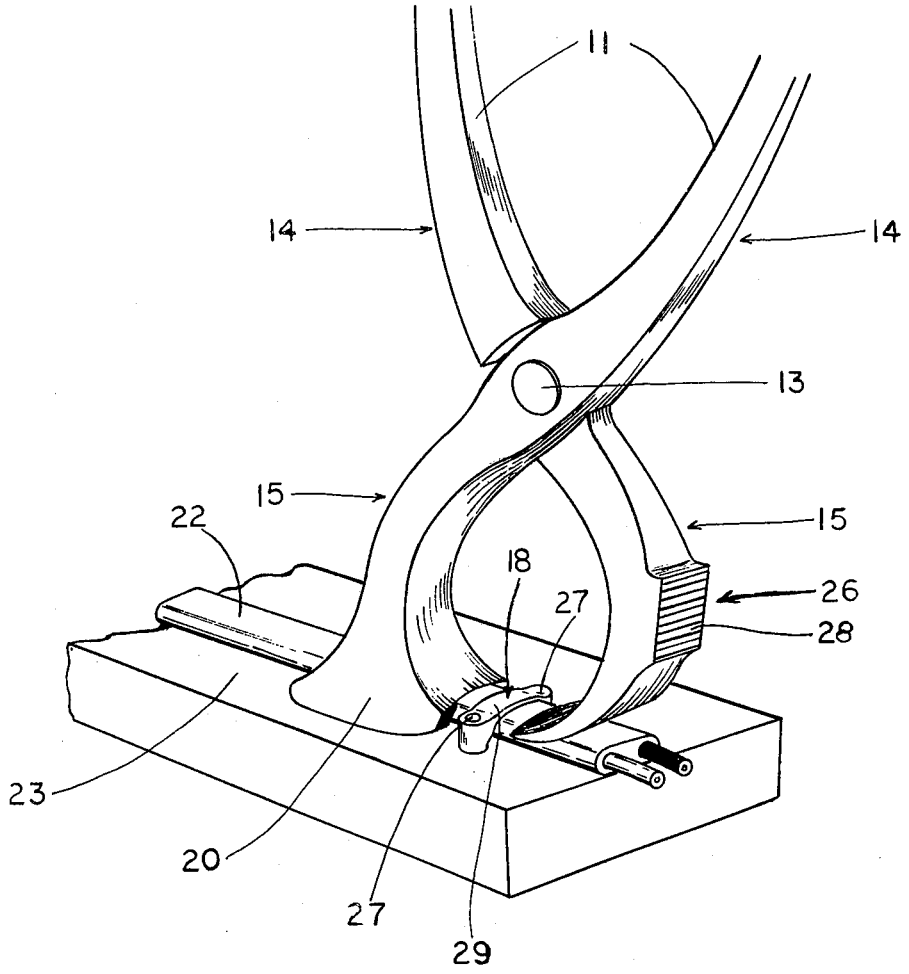
FIG. 3 is a perspective view of the hand tool of this invention as it normally engages a staple to be removed.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device and such further applications of the principles of the invention as illustrated therein being contemplated as would normally occur to one skilled in the art to which the invention relates.

Referring now more particularly to the drawings, a pair of levers 11 are pivotally connected at a pivot point 12 by a suitable pivot pin 13. Each of the levers 11 is approximately 9 inches long, although the size is not critical and may be varied to suit the individual user. The proximal portion 14 of levers 11 are shaped to serve as handles 11A and 11B. This shaping can be accomplished in a variety of ways, although preferably this refers to a rounding and grooving of the proximal portion 14 of levers 11 to a size and configuration that would fit normal sized hands. The advantage of shaping handles 11A and 11B is that they provide a better grip for the user of the hand tool of this invention. For purposes of this application, pivotal connection point 12 shall be used as the point of demarcation between proximal and distal when referring to levers 11.

The distal end portions 15 of levers 11 are formed into coacting jaws 16 which comprise basically jaw members 16A and 16B. Each of the jaw members 16A and 16B is preferably the same size and shape. Opposing surfaces 17A and 17B are the actual grasping surfaces where jaw members 16A and 16B engage and grasp a staple 18. Opposing surfaces 17A and 17B are machined in a manner such that they can be used for cutting and severing the electrical wire 22. In addition, a plane is defined by distal edges 19A and 19B. Preferably, jaw members 16A and 16B define parallel distal edges 19A and 19B, respectively, which would intersect when the hand tool was closed and which could be used to cut electrical wire 22. In the preferred embodiment of this invention, surfaces 17A and 17B are concave in the manner shown in FIG. 1 of the drawing. This general contour allows former grasping of staples 18 which are generally contoured in a similar manner.

A fulcrum member 20 is integrally mounted onto jaw member 16A. Preferably, fulcrum member 20 and one of said levers 11 are extruded, cast, or otherwise manufactured as a single piece. The fulcrum member 20 is laterally offset from the center 21 of jaw member 16A in order to facilitate convenient removal of staples 18 without damaging the wire 22. In addition to being laterally offset from the center 21 of jaw member 16A fulcrum member 20 also extends beyond the distal edge 19A a distance approximately equivalent to the width or thickness of the insulated electrical wire 22 normally used to connect electrical outlets. The extension beyond distal edge 19A of fulcrum member 20 is important in that immediately upon grasping the staple 18 with jaws 16A and 16B, the fulcrum member 20 is in contact with supporting structure 23 to provide a fulcrum for the application of a manual force to handles 11A and 11B with the net result being the removal of staple 18 without damage to wire 22. Although the drawing depicts one fulcrum member 20 on jaw 16, a pair of fulcrum members 20 may be mounted on the jaw 16 to provide greater strength. However, one fulcrum member 20 has been found adequate for most standard uses of the hand tool of this invention. When the coacting jaws 16 have engaged the staple 18 by means of a gripping pressure applied by hand or other means on handles 11A and 11B. The fulcrum member 20 is in position beside the wire 22 to allow a pressure point to be on the supporting structure 23 rather than the wire 22. Therefore, by applying a pushing or pulling pressure on handles 16A and 16B of the levers 11 of fulcrum member 20 is used as the pressure point and the staple can be easily removed. In addition, if coacting jaws 16 have engaged electrical wire 22 and a sufficient gripping pressure is applied, they can be used to cut or sever the wire 22.

On the jaw 16B opposite the jaw 16A having fulcrum member 20 mounted thereon, a hammerhead member 26 is preferably mounted. Hammerhead member 26 is of a width sufficient to allow contact with both of the nails 27 required to fix staple 18 in its proper mounted position. Preferably, hammerhead member 26 and lever 11B are extruded, cast or otherwise manufactured as a single piece. Preferably, the outermost surface 28 of hammerhead member 26 is flat and rectangular in area. Although the presence of hammerhead member 26 on jaw 16B is preferable, it is not necessary for the utility of the hand tool of this invention.

The staples 18 which are generally used in the mounting of electrical wire 22 to a base support structure 23 are generally one of two types. The first comprises a plastic body portion 29 having openings for two nails 27. The other type is the metal staple of the same basic type again having two openings for nails 27.

By use of the hand tool of this invention, the contoured jaw members 16A and 16B can be used to firmly grasp and remove the body portion 29 and nails 27 of either the metal or plastic staples 18. This is accomplished by applying a clamping force to handles 11A and 11B followed by a pulling or pushing pressure to those same handles with the fulcrum member 20 as the pressure point. The staples are easily removed without any resulting damage to the wire 18. This is extremely important for a variety of reasons, only one of which is the possibility of a dangerous short circuit developing if the fulcrum member 20 should penetrate the wire. For this reason, it is important that the fulcrum member 20 be offset from the center 21 of the jaws 16.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention and the scope of the claims are also desired to be protected.

What is claimed is:

1. A hand tool for use with electrical wire staples comprising:

a. a pair of levers pivotally connected at a point intermediate to the proximal and distal ends of said levers;

b. handle members being adapted from the portions of said levers located proximal to said point of pivotal connection;

c. first and second coacting jaw members adapted from the portion of said levers located distal to said point of pivotal connection, said coacting jaw members having opposing surfaces, said opposing surfaces having distal edges; and d. a fulcrum member attached to said first coacting jaw member, said fulcrum member being laterally offset from and parallel to the longitudinal center of said first jaw member and extending beyond a plane through said distal edges of said jaw members.

2. The hand tool of claim 1 wherein said fulcrum member extends beyond a plane through said distal edges of said jaw members a distance approximately equal to the width of standard insulated electrical wire.

3. The hand tool of claim 1 wherein a hammerhead member is mounted on said second coacting jaw member.

4. The hand tool of claim 1 wherein two fulcrum members are attached to said first coacting jaw member, each of said fulcrum members being laterally offset from the center of said first jaw member and each extending beyond said plane through said distal edges of said jaw members.

5. The hand tool of claim 1 wherein said portion of said levers located proximal to said point of pivotal connection comprises approximately from about 65 percent to about 90 percent of the total length of each of said levers.

6. A hand tool for use with electrical wire staples comprising:

a. a pair of levers pivotally connected at a point intermediate to the proximal and distal ends of said levers, said intermediate point being from about 65 percent to about 90 percent of the total length of each of said levers;

b. handle members being adapted from the portions of said levers located proximal to said point of pivotal connection;

c. first and second coacting jaw members adapted from the portion of said levers located distal to said point pivotal connection, said coacting jaw members having opposing surfaces, said opposing surfaces having distal edges defining a plane;

d. at least one fulcrum member attached to said first coacting jaw member, said fulcrum member being laterally offset from and parallel to the longitudinal center of said first jaw member and extending beyond a plane through said distal edges of said jaw members a distance approximately equal to the width of standard electrical wire; and e. a hammerhead member mounted on said second coacting jaw member.

* * * * *